US007592986B2

(12) United States Patent
You et al.

(10) Patent No.: US 7,592,986 B2
(45) Date of Patent: Sep. 22, 2009

(54) DISPLAY DEVICE AND DRIVING METHOD THEREOF

(75) Inventors: Bong-Hyun You, Yongin-si (KR); Min-Koo Han, Seoul (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 659 days.

(21) Appl. No.: 11/322,074

(22) Filed: Dec. 29, 2005

(65) Prior Publication Data

US 2006/0145968 A1 Jul. 6, 2006

(30) Foreign Application Priority Data

Dec. 31, 2004 (KR) ..... 10-2004-0117735

(51) Int. Cl.
*G09G 3/32* (2006.01)

(52) U.S. Cl. ..... 345/82; 438/149; 349/42; 313/504

(58) Field of Classification Search ..... 438/149–167; 313/504; 349/42
See application file for complete search history.

(56) References Cited

U.S. PATENT DOCUMENTS

2004/0142502 A1* 7/2004 Yoo et al. ..... 438/24
2005/0259703 A1* 11/2005 You et al. ..... 372/38.07
2006/0027819 A1* 2/2006 Hu ..... 257/83
2006/0097965 A1* 5/2006 Deane et al. ..... 345/76
2006/0221004 A1* 10/2006 You et al. ..... 345/76
2007/0242176 A1* 10/2007 Chang et al. ..... 349/42
2008/0068877 A1* 3/2008 Takahashi et al. ..... 365/156
2008/0180024 A1* 7/2008 Kwon ..... 313/504

* cited by examiner

*Primary Examiner*—Amare Mengistu
*Assistant Examiner*—Premal Patel
(74) *Attorney, Agent, or Firm*—F. Chau & Associates, LLC

(57) ABSTRACT

A display device includes a light emitting diode, and first and second driving transistors connected between a driving voltage and the light emitting diode to supply driving electric current to the light emitting diode. A control voltage or control voltages differentiated in polarity from each other is/are applied to control terminals of the first and the second driving transistors. The first driving transistor has a control electrode located below a semiconductor layer of the light emitting diode while the second driving transistor has a control electrode located over the semiconductor layer. Two driving transistors are formed at each pixel, and an area occupied thereof within the pixel is reduced. Control voltages differentiated in polarity from each other are applied to the respective driving transistors, substantially preventing deterioration of the driving transistors.

18 Claims, 10 Drawing Sheets

DISPLAY DEVICE AND DRIVING METHOD THEREOF

CROSS-REFERENCE TO RELATED PATENT APPLICATION

This application claims the benefit of Korean Patent Application No. 10-2004-0117735, filed on Dec. 31, 2004, in the Korean Intellectual Property Office, herein incorporated by reference in its entirety.

BACKGROUND OF THE INVENTION (a) Field of the Invention

The present invention relates to a display device, and a method of driving the display device.

(b) Discussion of Related Art

In designing personal computers and televisions having light-weight and reduced form factor, display devices are needed having light-weight and flat profiles. To satisfy such needs, cathode ray tubes (CRTs) have been replaced by flat panel display devices.

A flat panel display device may be a liquid crystal display (LCD), a field emission display (FED), an organic light emitting display, a plasma display panel (PDP), etc.

Typically, flat panel display devices include a plurality of pixels arranged in the form of a matrix, and the light intensity at each pixel is controlled depending upon given luminance information. The organic light emitting display electrically excites luminescent organic material, and emits light to display the desired images. The organic light emitting display characteristics include self-light emission, lower power consumption, wide viewing angle and short response time. The organic light emitting display may display high quality moving picture images.

The organic light emitting display includes organic light emitting diodes (OLEDs), and thin film transistors (TFTs) for driving the OLEDs. The TFTs are classified into a polycrystalline silicon TFT and an amorphous silicon TFT depending upon a type of active layer. The organic light emitting display using the polycrystalline silicon TFTs exhibits various advantages, and has been extensively used. However, manufacture of the organic light emitting display using the polycrystalline silicon TFTs involves complicated processing steps and increased production cost, and it can be difficult to obtain a wide screen with such an organic light emitting display.

A wide screen can more easily be manufactured in an organic light emitting display implementing the amorphous silicon TFT, which involves simplified processing steps compared to the organic light emitting display using the polycrystalline silicon TFT. In the organic light emitting display using the amorphous silicon TFT, a threshold voltage Vth shifts and deteriorates as an electric current is continuously applied to the OLED. As a result, an uneven electric current flows through the OLED even under the application of the same data voltage. For this reason, the display quality of the organic light emitting display using the amorphous silicon TFT is deteriorated.

Therefore, a need exists for a display device that has amorphous silicon thin film transistors and substantially prevents the deterioration of the threshold voltage thereof, and a method of driving the display device.

SUMMARY OF THE INVENTION

According to an embodiment of the present invention, a display device includes a light emitting diode, and first and second driving transistors connected between a driving voltage and the light emitting diode to supply driving current to the light emitting diode. A control voltage or control voltages differentiated in polarity from each other is/are applied to control terminals of the first and the second driving transistors. The first driving transistor has a control electrode located below a semiconductor layer of the light emitting diode while the second driving transistor has a control electrode located over the semiconductor layer of the light emitting diode.

A capacitor is connected to the control terminals of the first and the second driving transistors, and a switching transistor transmits a data voltage to the capacitor in accordance with a scanning signal. The control terminals of the first and the second driving transistors may be connected to each other.

First and second control voltages are applied to the control terminals of the first and the second driving transistors, respectively. The polarities of the first and the second control voltages may be alternated per image frame.

A first capacitor is connected to the control terminal of the first driving transistor to charge and apply a first control voltage to the control terminal of the first driving transistor, and a second capacitor is connected to the control terminal of the second driving transistor to charge and apply a second control voltage to the control terminal of the second driving transistor.

A first switching transistor transmits a first data voltage to the first capacitor in accordance with a scanning signal, and a second switching transistor transmits a second data voltage to the second capacitor in accordance with the scanning signal.

The first and the second data voltages may be differentiated in polarity from each other.

The polarities of the first and the second data voltages may be alternated per image frame.

The display device may further include a first switching transistor for transmitting a first data voltage to the first capacitor in accordance with a first scanning signal, a second switching transistor for transmitting a second data voltage to the second capacitor in accordance with the first scanning signal, a third switching transistor for transmitting the second data voltage to the first capacitor in accordance with a second scanning signal, and a fourth switching transistor for transmitting the first data voltage to the second capacitor in accordance with the second scanning signal.

The first and the second data voltages may be differentiated in polarity from each other.

The first and the second scanning signals may be activated in different image frames.

The first and the second driving transistors may be amorphous silicon thin film transistors.

The first and the second driving transistors may be nMOS thin film transistors.

The light emitting diode may include an organic light emitting layer.

According to an embodiment of the present invention, a display device includes a substrate, a first control electrode formed on the substrate, an insulating layer formed on the first control electrode, a semiconductor formed on the insulating layer, input and output electrodes formed on the semiconductor, a passivation layer formed on the input and the output electrodes, and a second control electrode formed on the passivation layer. First and second control voltages differentiated in polarity from each other are applied to the first and the second control electrodes, respectively.

The polarities of the first and the second control voltages may be alternated per image frame.

An etch stopper may be formed between the semiconductor and the passivation layer.

According to an embodiment of the present invention, a method of driving a display device with a light emitting diode, first and second driving transistors connected to the light emitting diode and first and second capacitors connected to the first and the second driving transistors includes applying a positive control voltage to a control terminal of the first driving transistor in a first image frame, applying a negative control voltage to a control terminal of the second driving transistor in the first image frame, applying a negative control voltage to the control terminal of the first driving transistor in a second image frame, and applying a positive control voltage to the control terminal of the second driving transistor in the second image frame.

The method may further include applying a positive data voltage to the first capacitor in the first image frame, applying a negative data voltage to the second capacitor in the first image frame, applying a negative data voltage to the first capacitor in the second image frame; and applying a positive data voltage to the second capacitor in the second image frame.

BRIEF DESCRIPTION OF THE DRAWINGS

The present invention will become more apparent by describing embodiments thereof in detail with reference to the accompanying drawings in which.

DETAILED DESCRIPTION OF PREFERRED EMBODIMENTS

Figure 1:
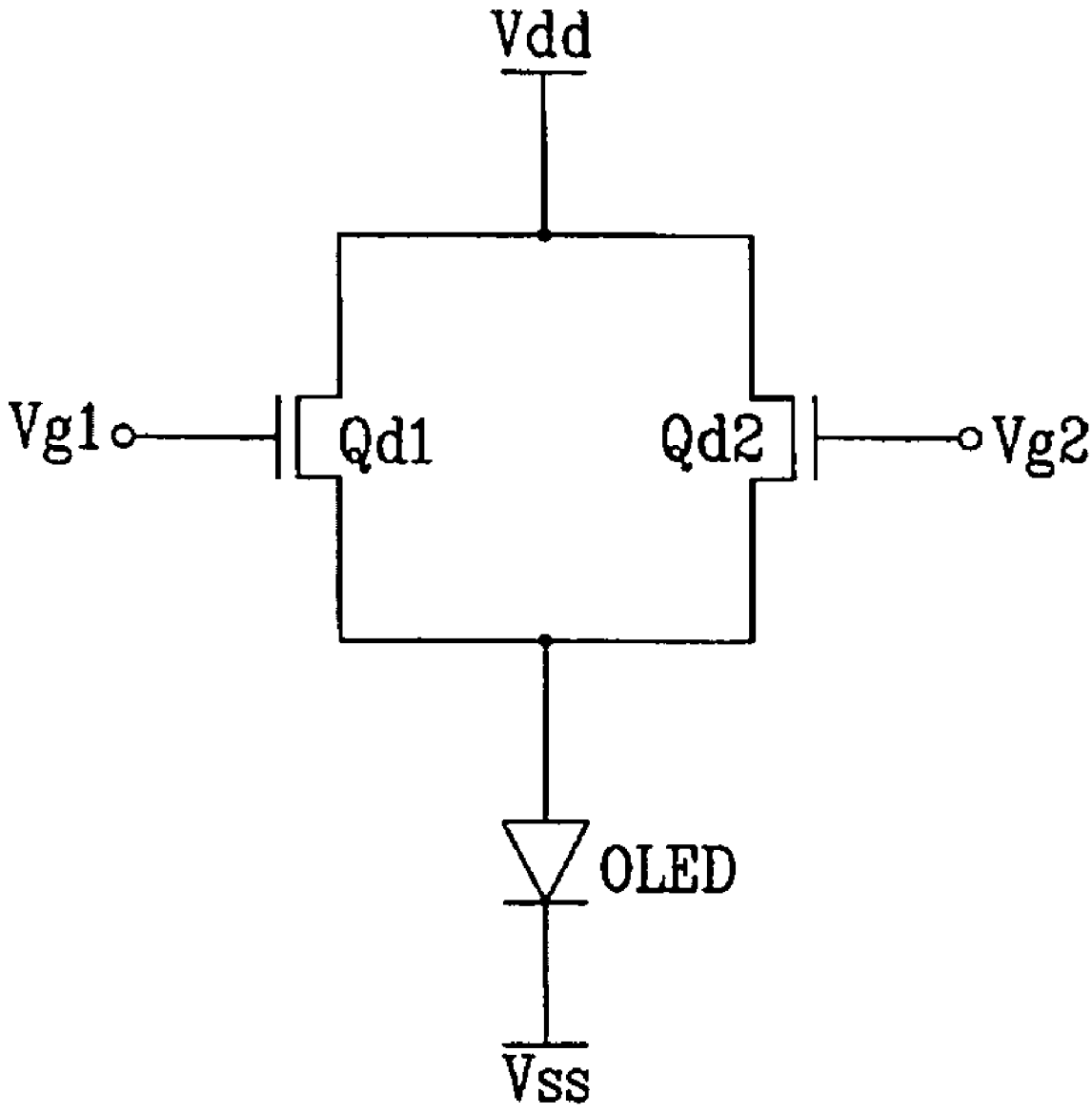
FIG. 1 is an equivalent circuit diagram of an organic light emitting unit according to an embodiment of the present invention.

The present invention now will be described more fully hereinafter with reference to the accompanying drawings, in which preferred embodiments of the invention are shown. The present invention may, however, be embodied in many different forms and should not be construed as limited to embodiments set forth herein.

In the drawings, the thickness of layers, films and regions are exaggerated for clarity. Like numerals refer to like elements throughout.

Now, display devices according to embodiments of the present invention and driving methods thereof will be described with reference to the accompanying drawings.

Figure 2:
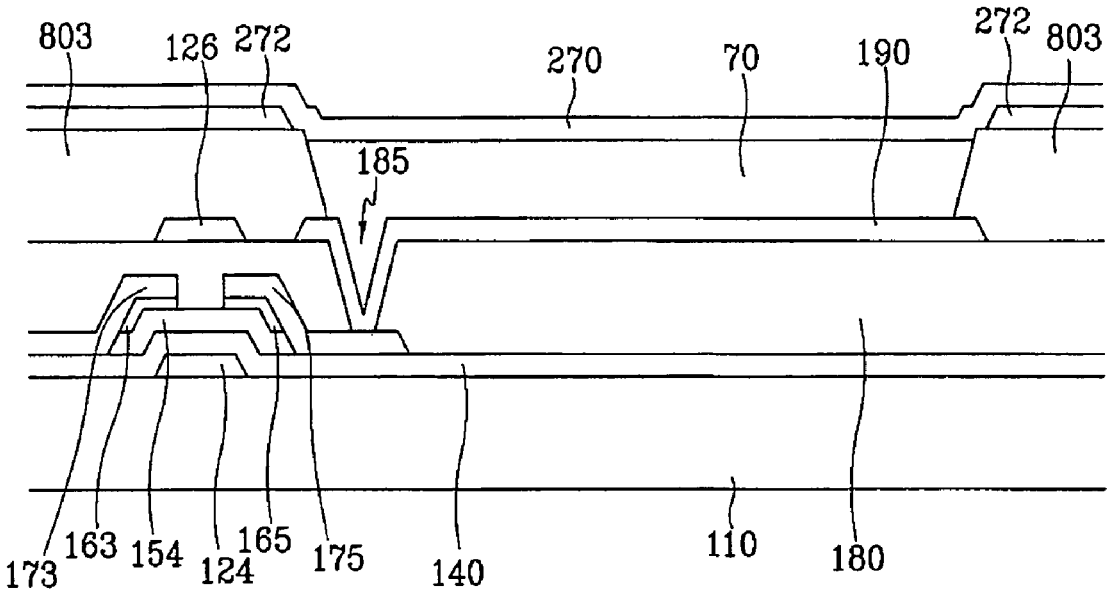
FIG. 2 is a sectional view of an organic light emitting unit according to an embodiment of the present invention.
Figure 3:
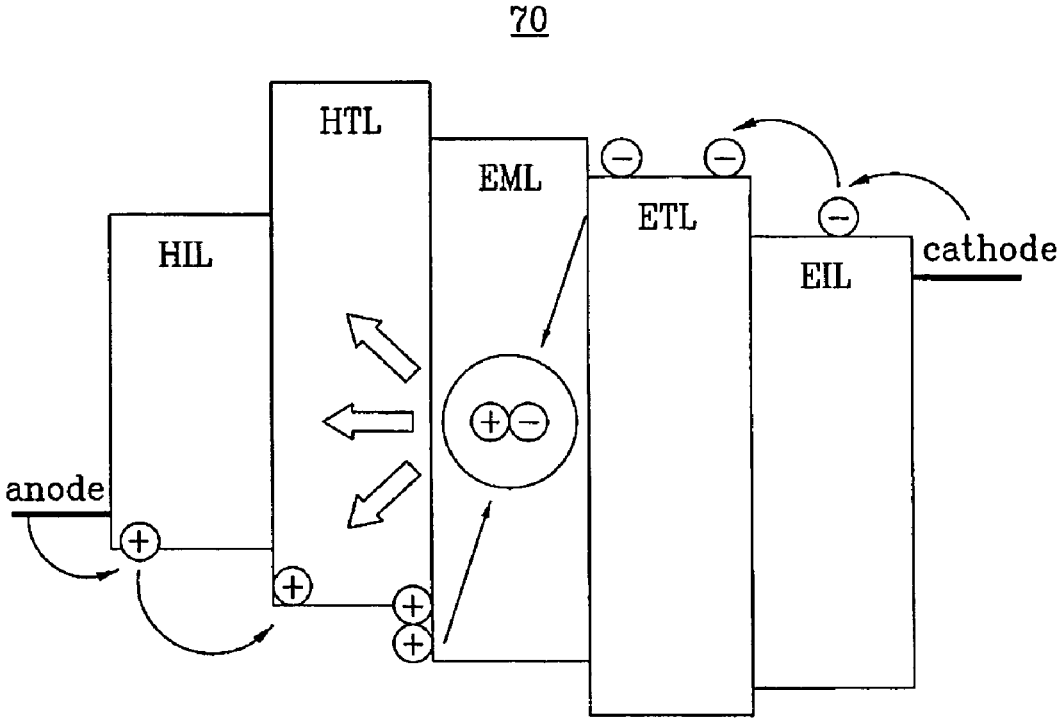
FIG. 3 is a schematic view of an organic light emitting diode according to an embodiment of the present invention.

FIG. 1 is an equivalent circuit diagram of an organic light emitting unit according to an embodiment of the present invention. FIG. 2 is a sectional view of an organic light emitting unit according to an embodiment of the present invention. FIG. 3 is a schematic view of an organic light emitting diode according to an embodiment of the present invention.

As shown in FIG. 1, an organic light emitting unit includes first and second driving transistors Qd1 and Qd2, and an organic light emitting diode OLED.

The first and the second driving transistors Qd1 and Qd2 have triode structures with input terminals connected to each other to receive a driving voltage Vdd, output terminals connected to each other, and control terminals for receiving control voltages Vg1 and Vg2, respectively. The output terminals of the transistors Qd1 and Qd2 are connected to the OLED.

An anode and a cathode of the OLED are connected to the output terminals of the first and the second driving transistors Qd1 and Qd2, and a common voltage Vss, respectively. The OLED emits light under the application of a voltage exceeding a threshold voltage of the OLED between the anode and the cathode. An intensity of the light is varied in accordance with the voltage of an electric current $I_{OLED}$ from the first and the second driving transistors Qd1 and Qd2. Consequently, the OLED displays the desired images. The voltage of electric current $I_{OLED}$ depends upon the voltage between the control and the output terminals of the first and the second driving transistors Qd1 and Qd2.

The first and the second driving transistors Qd1 and Qd2 are formed with n channel metallic oxide film semiconductor nMOS transistors based on amorphous silicon or polycrystalline silicon. Alternatively, the transistors Qd1 and Qd2 may be formed with pMOS transistors. In this case, as the pMOS transistor and the nMOS transistor are complementary to each other, the operation, voltage and electric current of the pMOS transistor are opposite to those of the nMOS transistor.

As shown in FIG. 2, a first control electrode 124 is formed on an insulating substrate 110. The insulating substrate 110 may be an aluminum-based metallic material such as aluminum and aluminum alloy, a silver-based metallic material such as silver and silver alloy, a copper-based metallic material such as copper and copper alloy, a molybdenum-based metallic material such as molybdenum and molybdenum alloy, chromium, titanium, or tantalum. A lateral sides of the first control electrode 124 is inclined with respect to a surface of the insulating substrate 110 at about 20-80°.

An insulating layer 140 is formed on the first control electrode 124. The insulating layer 140 is formed of, for example, silicon nitride SiNx.

A semiconductor 154 is formed on the insulating layer 140. The semiconductor 154 is formed of, for example, hydrogenated amorphous silicon (abbreviated as a-Si) or polycrystalline silicon.

Ohmic contacts 163 and 165 are formed on the semiconductor 154. The ohmic contacts 163 and 165 are formed of, for example, silicide, or n+ hydrogenated amorphous silicon where n type impurities are doped at high concentration.

The lateral sides of the semiconductor 154 and the ohmic contacts 163 and 165 are inclined at about 30-80°.

An input electrode 173 and an output electrode 175 are formed on the ohmic contacts 163 and 165, respectively, and the insulating layer 140. The input electrode 173 and the output electrode 175 are formed of, for example, a chromium or molybdenum-based metallic material, or a refractory metallic material such as tantalum and titanium.

The input electrode 173 and the output electrode 175 are separated from each other, and located at opposite sides of the first control electrode 124. The first control electrode 124, the input electrode 173 and the output electrode 175 constitute a first driving transistor Qd1 together with the semiconductor 154. The channel of the first driving transistor Qd1 is formed at the semiconductor 154 between the input and the output electrodes 173 and 175.

As like with the semiconductor 154, the lateral sides of the input and the output electrodes 173 and 175 are inclined at 30-80°, respectively.

A passivation layer 180 is formed on the input and the output electrodes 173 and 175 and an exposed portion of the semiconductor 154. The passivation layer 180 is formed of an organic material, a low dielectric insulating material such as a-Si:C:O and a-Si:O:F formed through plasma enhanced chemical vapor deposition (PECVD), or silicon nitride SiNx. The material of the passivation layer 180 may have a flattening characteristic or photosensitivity.

A contact hole 185 is formed in the passivation layer 180 to expose the output electrode 175.

A pixel electrode 190 is formed on the passivation layer 180 such that it is electrically connected to the output electrode 175 through the contact hole 185. The pixel electrode 190 is formed of a transparent conductive material such as indium tin oxide (ITO) or indium zinc oxide (IZO), or a high reflection material such as aluminum or silver alloy.

A second control electrode 126 is formed on the passivation layer 180, and is formed of the same material as the pixel electrode 190. A lateral side of the second control electrode 126 is inclined with respect to a surface of the substrate 110 at about 20-80°.

The second control electrode 126 is disposed on the input and the output electrodes 173 and 175. The second control electrode 126, and the input and the output electrodes 173 and 175 constitute a second driving transistor Qd2 together with the semiconductor 154. A channel of the second driving transistor Qd2 is formed at the semiconductor 154 between the input and the output electrodes 173 and 175.

A barrier 803 is formed on the passivation layer 180 and the second control electrode 126. The barrier 802 is formed of an organic insulating material or an inorganic insulating material, and isolates organic light emitting cells from each other. The barrier 803 surrounds a periphery of the pixel electrode 190, and defines a region to be filled with an organic light emitting layer 70.

An organic light emitting layer 70 is formed on the pixel electrode 190 surrounded by the barrier 803.

As shown in FIG. 3, the organic light emitting layer 70 has a multi-layered structure with an emitting layer (EML), and an electron transport layer (ETL) and a hole transport layer (HTL) for balancing electrons with holes to enhance the light emitting efficiency. The organic light emitting layer 70 may include an electron injecting layer (EIL) and a hole injecting layer (HIL).

A subsidiary electrode 272 is formed on the barrier 803 with substantially the same pattern as the barrier 803. The subsidiary electrode 272 is formed of a low resistivity conductive material such as a metallic material. The subsidiary electrode 272 contacts a common electrode 270, and substantially prevents the signal transmitted to the common electrode 270 from being distorted.

A common electrode 270 is formed on the barrier 803, the organic light emitting layer 70 and the subsidiary electrode 272 to receive the common voltage Vss. The common electrode 270 is formed of a transparent conductive material such as ITO and IZO. In case the pixel electrode 190 is formed with a transparent material, the common electrode 270 may be formed with a metallic material including calcium Ca, barium Ba and aluminum Al.

A non-transparent pixel electrode 190 and a transparent common electrode 270 may be implemented in a top emission type organic light emitting display where the target images are displayed to the top of the display panel. A transparent pixel electrode 190 and a non-transparent common electrode 270 may be implemented in a bottom emission type organic light emitting display where the target images are displayed to the bottom of the display panel.

The pixel electrode 190, the organic light emitting layer 70 and the common electrode 270 constitute the OLED shown in FIG. 1. The pixel electrode 190 functions as the anode, and the common electrode 270 as the cathode. Alternatively, the pixel electrode 190 may function as the cathode, and the common electrode 270 as the anode. The OLED intrinsically expresses one of the three primary colors red, green or blue, depending upon the organic material of the emitting layer (EML). The OLED realizes a desired color as a spatial sum of the three primary colors.

The first and the second control electrodes 124 and 126 are located below and over the semiconductor 154, respectively, forming two driving transistors Qd1 and Qd2 and reducing the area occupied by the pixel.

An organic light emitting unit according to an embodiment of the present invention will be now explained with reference to FIGS. 4 and 5.

Figure 4:
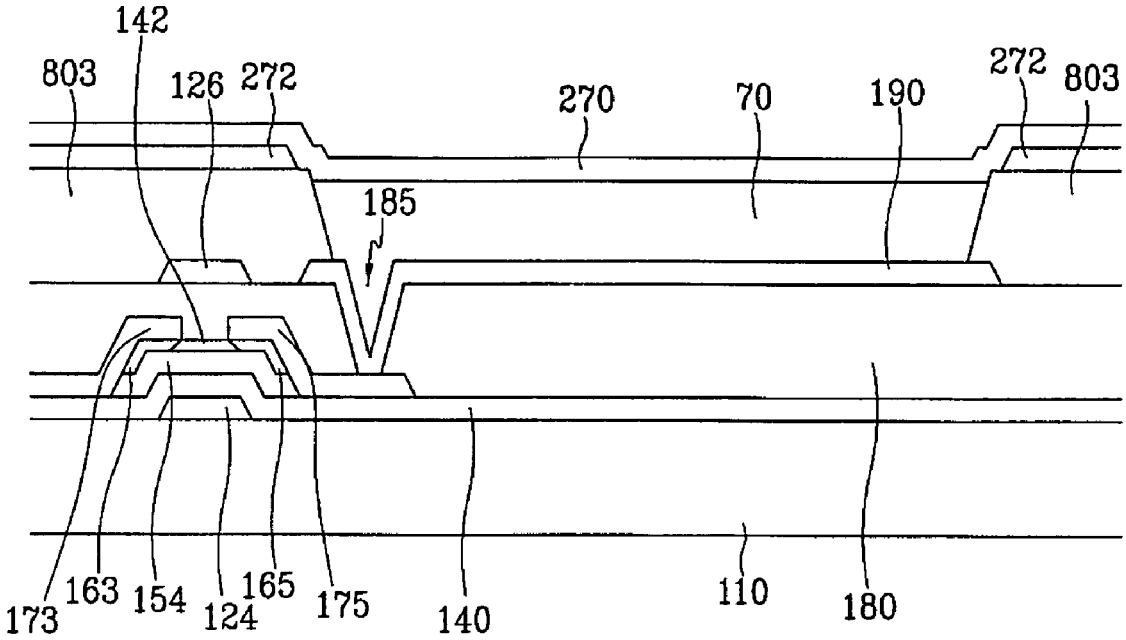
FIG. 4 is a sectional view of an organic light emitting unit according to another embodiment of the present invention.
Figure 5:
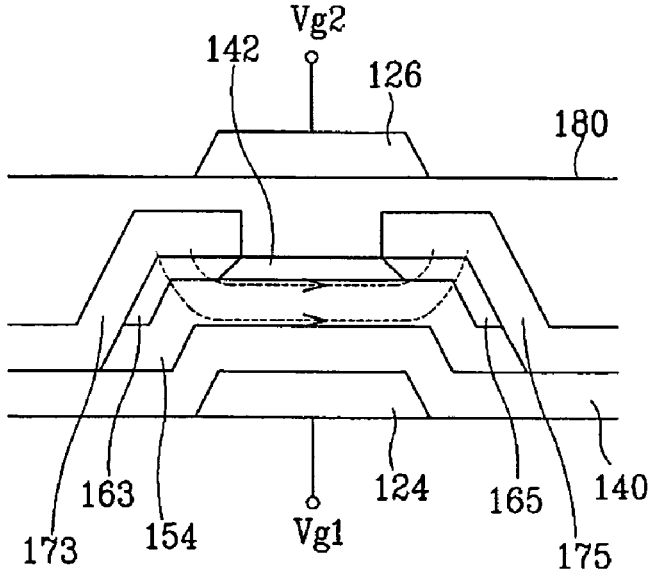
FIG. 5 is a schematic view of an electric current flow of a driving transistor of an organic light emitting unit according to an embodiment of the present invention.

FIG. 4 is a sectional view of an organic light emitting unit, and FIG. 5 is a schematic view of an electric current flow of a driving transistor of the organic light emitting unit.

The equivalent circuit of the organic light emitting unit is the same as that shown in FIG. 1, while the sectional structure of the organic light emitting unit shown in FIG. 4 is substantially similar to that shown in FIG. 2, and hence, detailed explanation thereof is omitted; new components will be explained in detail.

As shown in FIG. 4, an etch stopper 142 is formed on the semiconductor 154. The etch stopper 142 is formed of silicon nitride, and substantially prevents the top of the semiconductor 154 from being damaged in patterning the channel thereof.

A method of forming the organic light emitting unit according to an embodiment the present embodiment includes forming a conductive layer on an insulating substrate 110 through sputtering. The conductive layer may be formed of, for example, an aluminum-based metallic material such as aluminum and aluminum alloy, a silver-based metallic material such as silver and silver alloy, a copper-based metallic material such as copper and copper alloy, a molybdenum-based metallic material such as molybdenum and molybdenum alloy, chromium, titanium, or tantalum.

A first control electrode 124 is formed by etching the conductive layer through photolithography.

An insulating layer 140, a hydrogenated amorphous silicon layer and an etch stopper layer are sequentially deposited onto the first control electrode 124 through plasma enhanced chemical vapor deposition (PECVD) such that they cover the first control electrode 124. The etch stopper layer is patterned to thereby form an etch stopper 142. The insulating layer 140 and the etch stopper layer are formed of silicon nitride.

An N+ doped amorphous silicon layer is deposited, and the hydrogenated amorphous silicon layer and the N+ doped amorphous silicon layer are patterned to form a semiconductor 154 and ohmic contacts 163 and 165, and expose the etch stopper 142.

A conductive layer is deposited through sputtering, formed of a chromium or molybdenum-based metallic material, or a refractory metallic material such as tantalum and titanium. The conductive layer is etched through photolithography to form an input electrode 173 and an output electrode 175.

A passivation layer 180 is formed on the input and the output electrodes 173 and 175, and a contact hole 185 is formed in the passivation layer 180 through photolithography. In case the passivation layer 180 is formed with an organic layer having photosensitivity, the contact hole 185 may be formed through a photolithographic process.

A transparent conductive material such as ITO and IZO or a high reflection metallic material such as aluminum and silver alloy is deposited onto the passivation layer 180, and patterned to form a second control electrode 126 and a pixel electrode 190 connected to the output electrode 175 through the contact hole 185.

An organic film containing a black pigment is coated onto the passivation layer 180, and patterned to thereby form a barrier 803. In case the organic film has photosensitivity, the barrier can be formed through photolithography.

An organic light emitting layer 70 is formed at the respective pixel regions. The organic light emitting layer 70 has a multi-layered structure. The organic light emitting layer is formed through masking and depositing, or inkjet printing.

A subsidiary electrode 272 is formed on the barrier 803. The subsidiary electrode 272 is formed of a low resistance material. A common electrode 270 is deposited on the organic light emitting layer 70 and the subsidiary electrode 272. The common electrode 270 is formed of, for example, a high reflection metallic material such as aluminum and silver alloy or a transparent conductive material such as ITO and IZO thereon.

A conductive organic material may be deposited between the organic light emitting layer 70 and the common electrode 270 to form a buffer layer.

The electric current flow by way of the voltages Vg1 and Vg2 applied to the first and the second control electrodes 124 and 126 of the organic light emitting unit is illustrated in FIG. 5. The electric current due to the voltage Vg1 flows through a bottom interface of the semiconductor 154, and the electric current due to the voltage Vg2 through a top interface of the semiconductor 154.

After the etch stopper 142 is formed, the hydrogenated amorphous silicon layer and the N+ doped amorphous silicon layer are patterned to substantially prevent the top interface of the semiconductor 154 from being damaged. The top interface of the semiconductor 154, being the channel of the second driving transistor Qd2, has excellent characteristics, and the voltage-current characteristic of the second driving transistor Qd2 can be improved.

Figure 6:
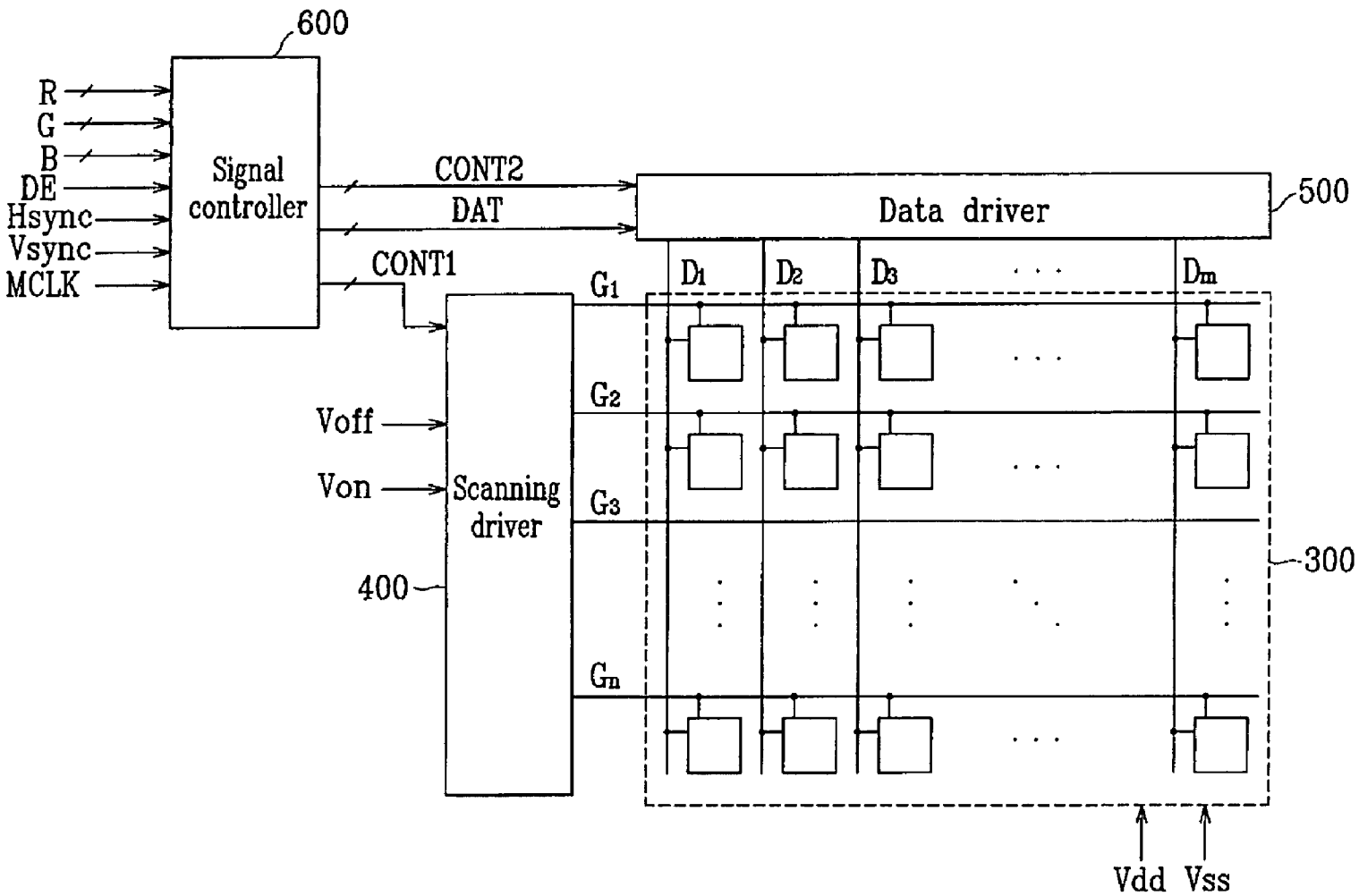
FIG. 6 is a block diagram of an organic light emitting display according to an embodiment of the present invention.
Figure 7:
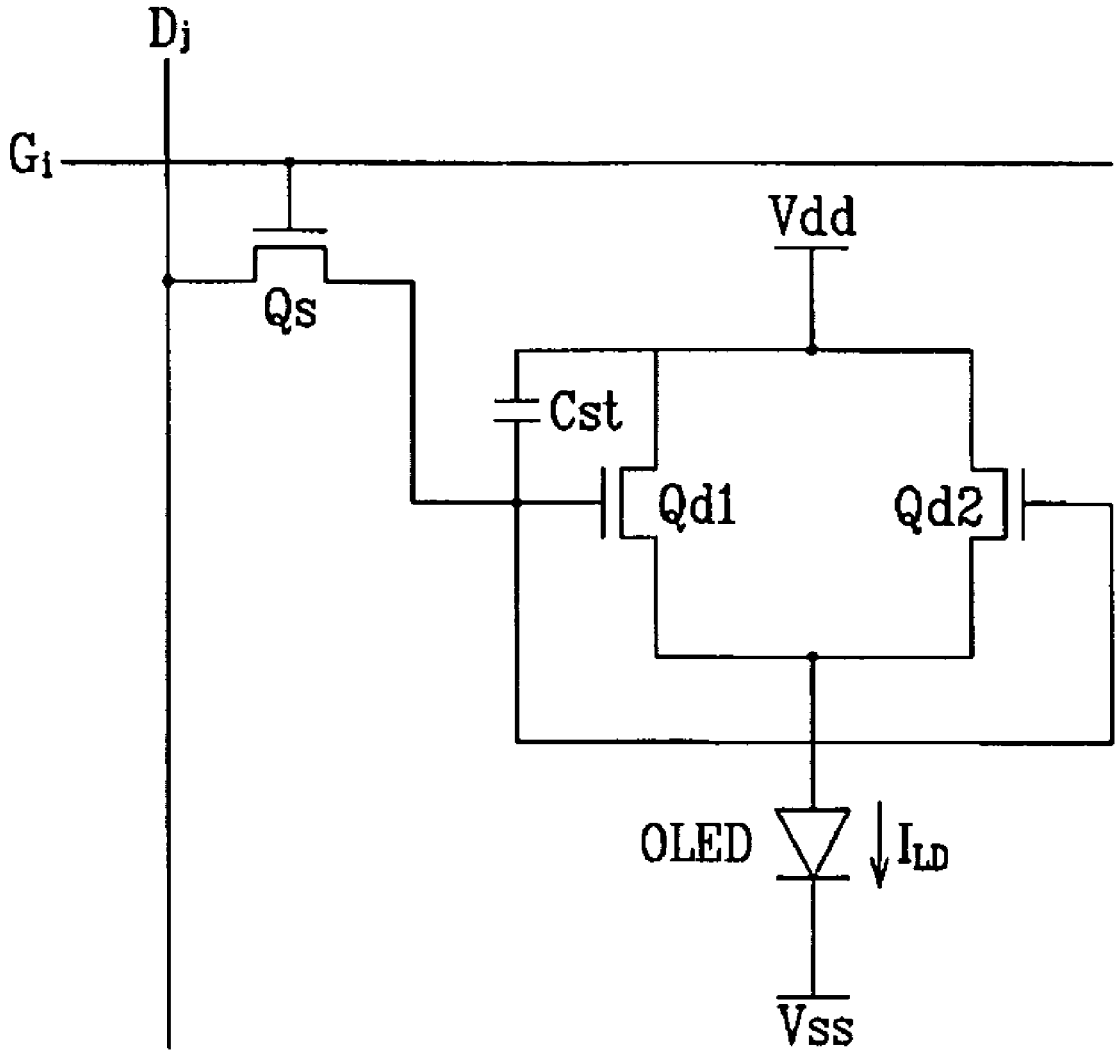
FIG. 7 is an equivalent circuit diagram of a pixel of an organic light emitting display according to an embodiment of the present invention.

FIG. 6 is a block diagram of an organic light emitting display according to an embodiment of the present invention, and FIG. 7 is an equivalent circuit diagram of a pixel of an organic light emitting display according to an embodiment of the present invention.

As shown in FIG. 6, an organic light emitting display includes a display panel 300, and scanning and data drivers 400 and 500 connected to the display panel 300. The organic light emitting display further includes a signal controller 600 for controlling the scanning and data drivers 400 and 500.

From an equivalent circuit perspective, the display panel 300 includes a plurality of signal lines G1-Gn and D1-Dm, a plurality of driving voltage lines (not shown), and a plurality of pixels connected to the driving voltage lines and signal lines and arranged in the form of a matrix.

The signal lines include a plurality of scanning signal lines G1-Gn for transmitting scanning signals, and data lines D1-Dm for transmitting data signals. The scanning signal lines G1-Gn extend substantially in the direction of pixel rows substantially parallel to each other, and the data lines D1-Dm extend substantially in the direction of pixel columns substantially parallel to each other.

The driving voltage lines transmit a driving voltage Vdd, and extend substantially in the direction of pixel rows or pixel columns.

As shown in FIG. 7, the respective pixels include an OLED, first and second driving transistors Qd1 and Qd2, a capacitor Cst, and a switching transistor Qs.

The first and the second driving transistors Qd1 and Qd2 have triode structures with input terminals connected to each other to receive a driving voltage Vdd, output terminals connected to each other, and control terminals connected to each other. The output terminals of the transistors Qd1 and Qd2 are connected to the OLED. The control terminals of the transistors Qd1 and Qd2 are connected to the switching transistor Qs and the capacitor Cst.

The anode and the cathode of the OLED are connected to the output terminals of the first and the second driving transistors Qd1 and Qd2 and the common voltage Vss, respectively.

The switching transistor Qs also has a triode structure with control and input terminals connected to the respective scanning and data lines G1-Gn and D1-Dm, and an output terminal connected to the control terminals of the first and the second driving transistors Qd1 and Qd2, and the capacitor Cst. As with the driving transistors Qd1 and Qd2, the switching transistor Qs is formed of an n channel metallic oxide film semiconductor nMOS transistor based on amorphous silicon or polycrystalline silicon. The switching transistor Qs transmits the data voltages from the data lines D1-Dm to the first and the second driving transistors Qd1 and Qd2 and the capacitor Cst in accordance with the scanning signals.

The capacitor Cst is disposed between the first and second driving transistors Qd1 and Qd2 and the switching transistor Qs and between the first and second driving transistors Qd1 and Qd2 and the driving voltage Vdd while being connected thereto. The capacitor Cst charges and holds the data voltage from the switching transistor Qs.

The first and the second driving transistors Qd1 and Qd2 output first and second electric currents depending upon the voltage Vgs between the control and the output terminals, and the OLED emits light of varying intensity depending upon the voltage of the sum of the first and the second electric currents $I_{OLED}$, displaying the desired images.

The OLED and the first and the second driving transistors Qd1 and Qd2 are the same as those of the organic light emitting unit described with respect to FIG. 1, and hence, detailed explanation thereof will be omitted.

As shown in FIG. 6, the scanning driver 400 is connected to the scanning signal lines G1-Gn of the display panel 300 to apply the scanning signals thereto. The scanning signals applied to scanning signal lines G1-Gn can include a high voltage Von capable of turning on the transistor Qs and a low voltage Voff capable of turning off the transistor Qs. The scanning driver 400 may be formed with a plurality of integrated circuits.

The data driver 500 is connected to the data lines D1-Dm of the display panel 300. The data driver 500 applies data voltages, representing the image signals, to the pixels. The data driver 500 may be formed of a plurality of integrated circuits.

The signal controller 600 controls the operation of the scanning driver 400 and the data driver 500.

The scanning and the data drivers 400 and 500 are mounted on a display panel 300 in the form of a plurality of driving integrated circuit chips, or mounted on a flexible printed circuit film (not shown) and attached to the display panel 300, for example, using a tape carrier package (TCP). Alternatively, the scanning and the data drivers 400 and 500 may be integrated on the display panel 300. The data driver 500 and the signal controller 600 may be integrated on a composite integrated circuit (IC) called a one-chip. In this case, the scanning driver 400 may be selectively integrated on the composite IC.

Then, the display operation of the organic light emitting display will be explained more specifically.

The signal controller 600 receives input image signals R, G and B, and input control signals for controlling those image signals from an external graphic controller (not shown). The control signals include vertical synchronization signals Vsync and horizontal synchronization signals Hsync, a main clock MCLK, and data enable signals DE. The signal controller 600 suitably processes the image signals R, G and B based on the input control signals pursuant to the operation conditions of the display panel 300, and generates scanning control signals CONT1 and data control signals CONT2. The signal controller 600 sends the scanning control signals CONT1 to the scanning driver 400, and the data control signals CONT2 and the processed image signals DAT to the data driver 500.

The scanning control signals CONT1 include vertical synchronization start signals STV for instructing the scanning driver 400 to start the scanning of the high voltage Von, and at least one clock signal for controlling the output of the high voltage Von.

The data control signals CONT2 include horizontal synchronization start signals STH for informing the data driver 500 of the data transmission to a row of pixels, load signals LOAD for applying the relevant data voltages to the data lines D1-Dm, and data clock signals HCLK.

The data driver 500 sequentially receives and shifts the image data DAT with respect to one pixel row in accordance of the control signals CONT2 from the signal controller 600, and applies the data voltages corresponding to the respective image data DAT to the relevant data lines D1-Dm.

The scanning driver 400 applies the high voltage Von to the scanning signal lines G1-Gn in accordance with the scanning control signals CONT1 from the signal controller 600, and turns on the switching transistor Qs connected to the scanning signal lines G1-Gn. The data voltages applied to the data lines D1-Dm are applied to a corresponding capacitor Cst through the turned on switching transistor Qs.

The capacitor Cst charges and holds the data voltages for one image frame. The first and the second driving transistors Qd1 and Qd2 generate electric currents based on the difference between the voltage charged at the capacitor Cst and the voltage of the output terminal, and transmit the electric currents to the OLED. The OLED emits light in accordance with the electric current $I_{OLED}$, which is the sum of the electric currents from the first and the second driving transistors Qd1 and Qd2, and displays the target images.

When one horizontal cycle or 1H (e.g., a cycle of synchronization signals Hsync and data enable signals DE) passes, the data driver 500 and the scanning driver 400 repeat the same operation with respect to a next pixel row. In this way, the gate on voltage Von is applied to the scanning lines G1-Gn sequentially for one image frame, applying the data voltage to the pixels of the display panel 300.

A lower data voltage is applied to the first and the second driving transistors Qd1 and Qd2, compared to the higher data voltage applied to a driving transistor, thereby obtaining substantially the same electric current $I_{OLED}$ as the output electric current by way of a common driving transistor. The stress due to the higher voltage applied to the common driving transistor is reduced so that the first and the second driving transistors Qd1 and Qd2 can be substantially prevented from deteriorating.

An organic light emitting display according to an embodiment of the present invention will be specifically explained with reference to FIGS. 8 to 10.

Figure 8:
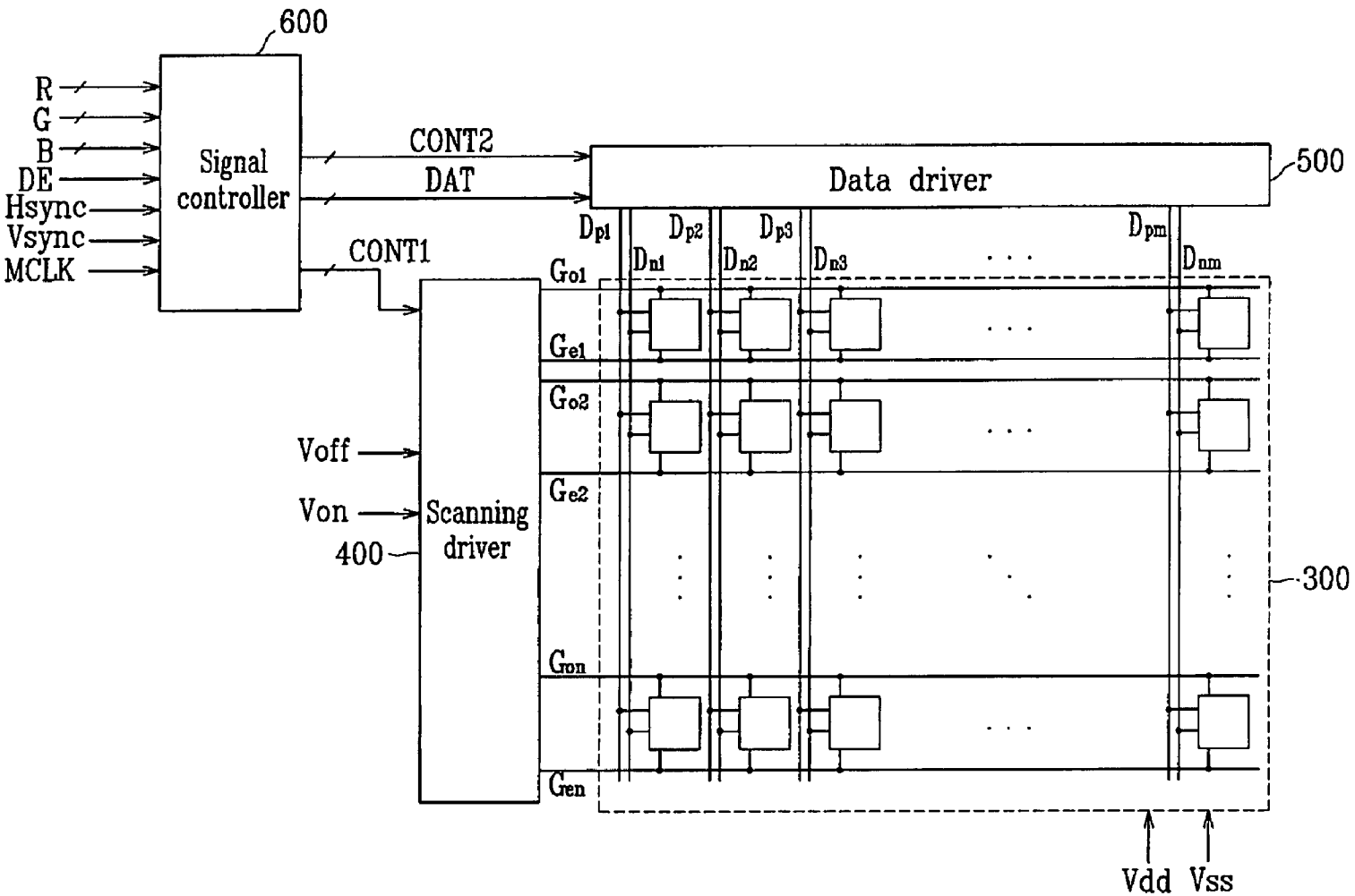
FIG. 8 is a block diagram of an organic light emitting display according to an embodiment of the present invention.

FIG. 8 is a block diagram of an organic light emitting display. FIG. 9 is an equivalent circuit diagram of a pixel of an organic light emitting display. FIG. 10 is a waveform diagram of a control voltage applied to a driving transistor of an organic light emitting display according to another embodiment of the present invention.

As shown in FIG. 8, the organic light emitting display includes a display panel 300, scanning and data drivers 400 and 500 connected to the display panel 300, and a signal controller 600 for controlling the scanning and data drivers 400 and 500.

From an equivalent circuit perspective, the display panel 300 includes a plurality of signal lines Go1-Gen and Dp1-Dnm, a plurality of driving voltage lines (not shown), and a plurality of pixels connected to the signal lines Go1-Gen and Dp1-Dnm and driving voltage lines and arranged substantially in the form of a matrix.

The signal lines include a plurality of first scanning signal lines Go1-Gon and second scanning signal lines Ge1-Gen for transmitting scanning signals during alternate image frames, e.g., odd-numbered frames and even-numbered frames, respectively. The signal lines include a plurality of first data lines Dp1-Dpm and second data lines Dn1-Dnm for transmitting positive polarity data signals and negative polarity data signals, respectively. The scanning signal lines Go1-Gen extend substantially in the pixel row direction substantially parallel to each other, and the data lines Dp1-Dnm extend substantially in the pixel column direction substantially parallel to each other. The positive and the negative polarities refer to the positive and the negative values with respect to a common voltage Vss, respectively.

The driving voltage lines transmit a driving voltage Vdd, and extend substantially in the pixel row or column direction.

Figure 9:
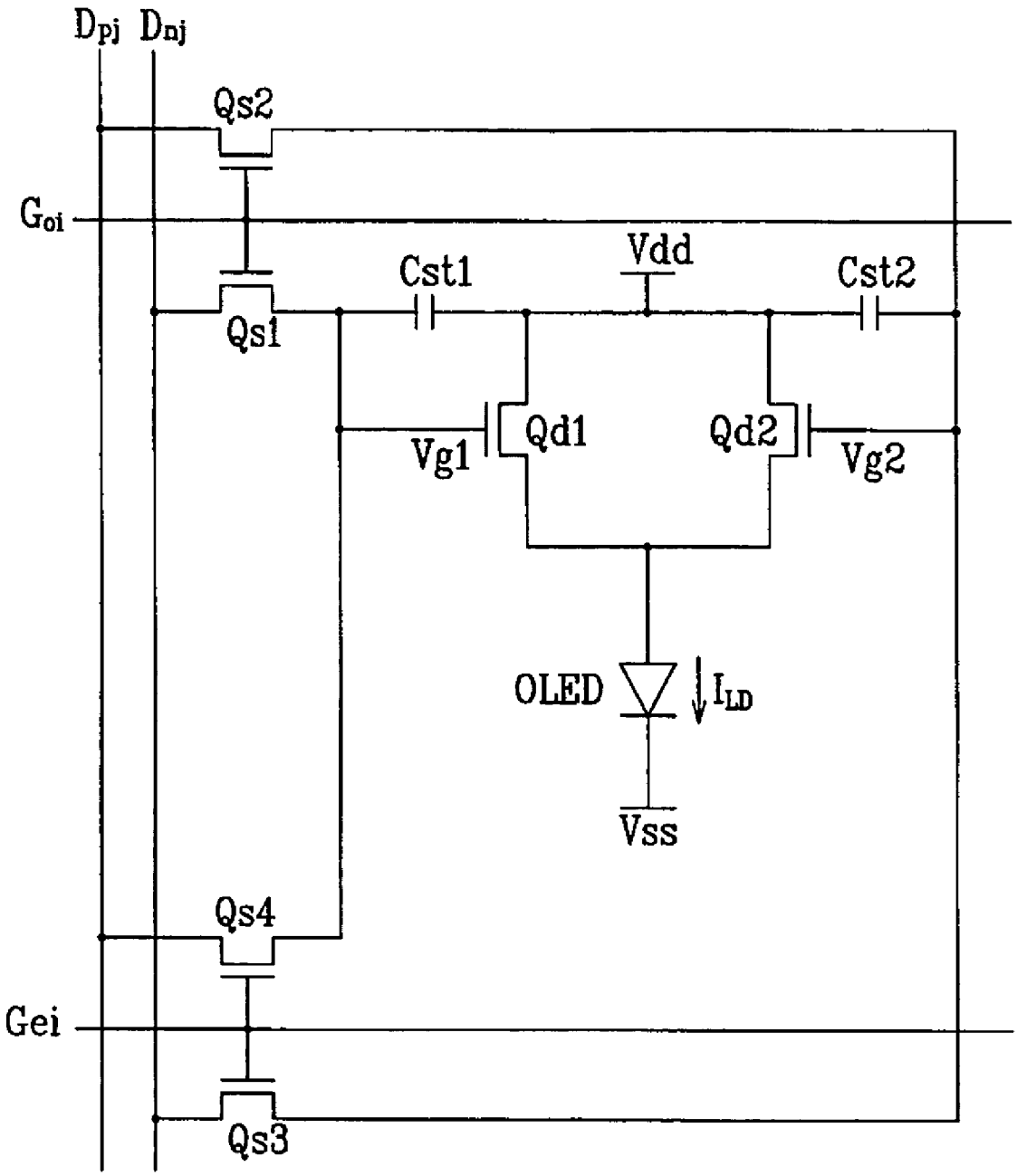
FIG. 9 is an equivalent circuit diagram of a pixel of an organic light emitting display according to an embodiment of the present invention.

As shown in FIG. 9, the respective pixels include an OLED, first and second driving transistors Qd1 and Qd2, first and second capacitors Cst1 and Cst2, and first to fourth switching transistors Qs1-Qs4.

The first and the second driving transistors Qd1 and Qd2 have triode structures with input terminals connected to each other to receive a driving voltage Vdd, and output terminals connected to each other. The output terminals of the transistors Qd1 and Qd2 are connected to the OLED. The control terminal of the first driving transistor Qd1 is connected to the first capacitor Cst1 and the first and the fourth switching transistors Qs1 and Qs4, and the control terminal of the second driving transistor Qd2 is connected to the second capacitor Cst2 and the second and the third switching transistors Qs2 and Qs3.

The anode and the cathode of the OLED are connected to the output terminals of the first and the second driving transistors Qd1 and Qd2, and the common voltage Vss, respectively.

The first to the fourth switching transistors Qs1-Qs4 each also have a triode structure. The control terminals of the first and the second switching transistors Qs1 and Qs2 are connected to the first scanning signal lines Go1-Gon, and the control terminals of the third and the fourth switching transistors Qs3 and Qs4 to the second scanning signal lines Ge1-Gen. The input terminals of the first and the third switching transistors Qs1 and Qs3 are connected to the second data lines Dn1-Dnm, and the input terminals of the second and the fourth switching transistors Qs2 and Qs4 to the first data lines Dp1-Dpm. The output terminals of the first and the fourth switching transistors Qs1 and Qs4 are connected to the control terminal of the first driving transistor Qd1 and the first capacitor Cst1. The output terminals of the second and the third switching transistors Qs2 and Qs3 are connected to the control terminal of the second driving transistor Qd2 and the second capacitor Cst2.

As with the driving transistors Qd1 and Qd2, the switching transistors Qs1-Qs4 are formed with n channel metallic oxide film semiconductor nMOS transistors based on amorphous silicon or polycrystalline silicon. The switching transistors Qs1-Qs4 transmit the data voltages from the data lines Dp1-Dnm to the driving transistors Qd1 and Qd2 and the capacitors Cst1 and Cst2 in accordance with the scanning signals.

The first capacitor Cst1 is connected between the control terminal of the first driving transistor Qd1 and the driving voltage Vdd, and charges and holds the data voltage from the switching transistors Qs1 and Qs4.

The second capacitor Cst2 is connected between the control terminal of the second driving transistor Qd2 and the driving voltage Vdd, and charges and holds the data voltage from the switching transistors Qs2 and Qs3.

The first and the second driving transistors Qd1 and Qd2 output first and second electric currents depending upon the voltage Vgs between the control terminal and the output terminal, and the OLED emits light of varying intensity depending upon the voltage of the first or the second electric current, thereby displaying the target images.

The structure of the OLED and the first and the second driving transistors Qd1 and Qd2 is the same as that of the organic light emitting unit described with respect to FIG. 1, and hence, detailed explanation thereof will be omitted.

As shown in FIG. 8, the scanning driver 400 is connected to the scanning signal lines Go1-Gen of the display panel 300 to apply scanning signals based on a combination of a high voltage Von capable of turning on the switching transistors Qs1-Qs4 and a low voltage Voff capable of turning off the switching transistors Qs1-Qs4. The scanning driver 400 may be formed of a plurality of integrated circuits.

The data driver 500 is connected to the data lines Dp1-Dnm of the display panel 300 to apply the positive data voltages representing the image signals to the first data lines Dp1-Dpm, and the negative data voltages for enhancing the stability of the driving transistors Qd1 and Qd2 to the second data lines Dn1-Dnm. The data driver 500 may be formed of a plurality of integrated circuits.

The signal controller 600 controls the operation of the scanning and the data drivers 400 and 500.

The display operation of the organic light emitting display includes the data driver 500 sequentially receiving and shifting the image data DAT with respect to a row of pixels in accordance with the data control signals CONT2 from the signal controller 600, and applying the positive data voltages corresponding to the respective image data DAT to the relevant data lines Dp1-Dpm. Furthermore, the data driver 500 applies the negative data voltages to the relevant data lines Dn1-Dnm. The negative data voltage has a predetermined voltage, and is preferably proportional to the voltage of the positive data voltage in the previous image frame.

In the odd-numbered frames, the scanning driver 400 applies the high voltage Von to the first scanning signal lines Go1-Gon in accordance with the scanning control signals CONT1 from the signal controller 600, and turns on the switching transistors Qs1 an Qs2 connected to the first scanning signal lines Go1-Gon. The positive data voltage applied to the first data lines Dp1-Dpm is applied to the relevant capacitor Cst2 via the turned on switching transistor Qs2, and the negative data voltage applied to the second data lines Dn1-Dnm is applied to the relevant capacitor Cst1 via the turned on switching transistor Qs1. The second driving transistor Qd2 is turned on in accordance with the positive voltage charged at the second capacitor Cst2, and outputs electric current. Upon receipt of the electric current $I_{OLED}$, the OLED emits light. The first driving transistor Qd1 is reverse-biased due to the negative voltage charged at the first capacitor Cst1. This operation is repeated with respect to the respective rows of pixels.

In the even-numbered frames, the scanning driver 400 applies the high voltage Von to the second scanning signal lines Ge1-Gen in accordance with the scanning control signals CONT1 from the signal controller 600, and turns on the switching transistors Qs3 an Qs4 connected to the second scanning signal lines Ge1-Gen. The positive data voltage applied to the first data lines Dp1-Dpm is applied to the relevant capacitor Cst1 via the turned on switching transistor Qs4, and the negative data voltage applied to the second data lines Dn1-Dnm is applied to the relevant capacitor Cst2 via the turned on switching transistor Qs3. The first driving transistor Qd1 is turned on in accordance with the positive voltage charged at the first capacitor Cst1, and outputs electric current. Upon receipt of the electric current $I_{OLED}$, the OLED emits light. The second driving transistor Qd2 is reverse-biased due to the negative voltage charged at the second capacitor Cst2. This operation is repeated with respect to the respective rows of pixels.

Figure 10:
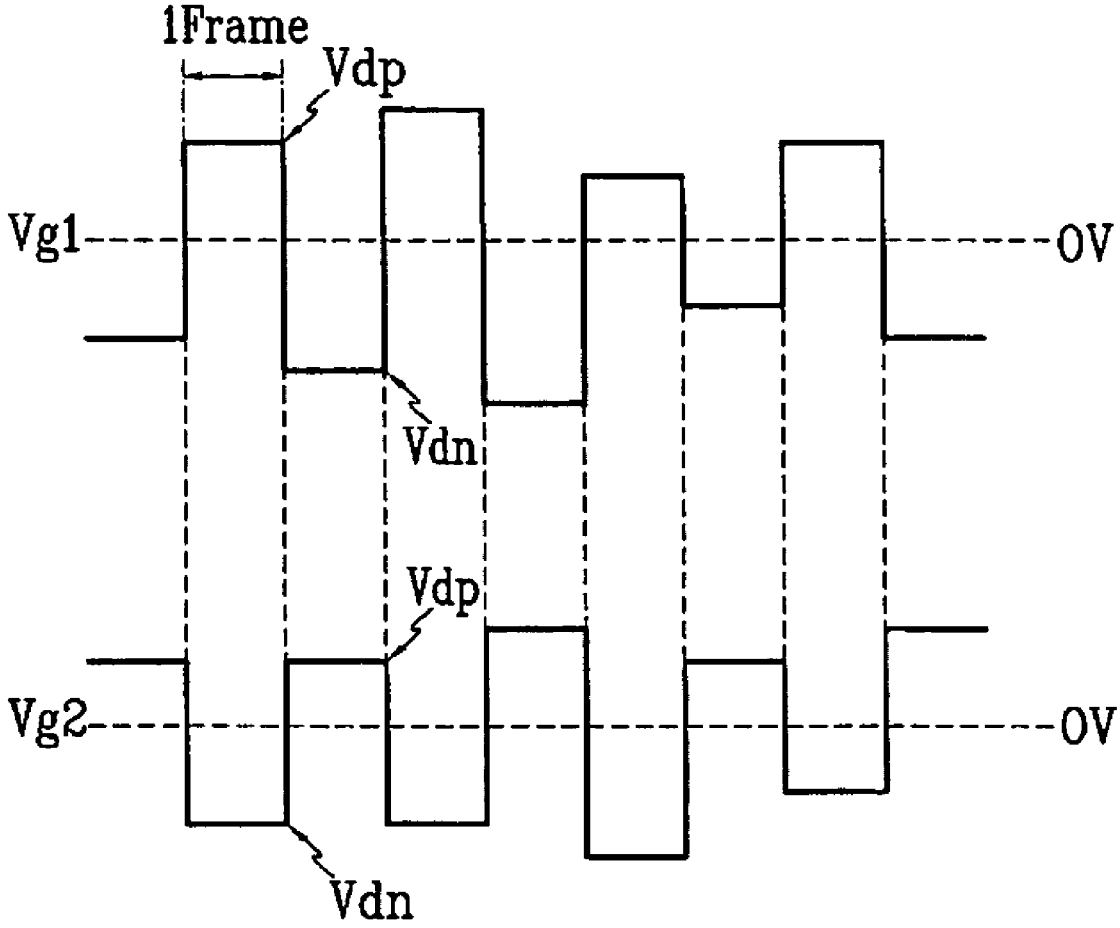
FIG. 10 is a waveform diagram illustrating the voltages input into a driver of an organic light emitting display according to an embodiment of the present invention.

As shown in FIG. 10, the polarities of the control voltages Vg1 and Vg2 applied to the control terminals of the driving transistors Qd1 and Qd2 at one pixel are opposite to each other in one image frame, and alternated per image frame. The positive control voltage Vdp is a data voltage for displaying the images, and the negative control voltage Vdn is a voltage for making the reverse-bias. With the negative control voltage Vdn, the stress due to the positive control voltage Vdp in the previous image frame is substantially removed, and the driving transistors Qd1 and Qd2 are substantially prevented from deteriorating. The voltage of the negative control voltage Vdn is preferably greater than the voltage of the positive control voltage Vdp in the previous frame.

A positive control voltage is applied to any one of the driving transistors in a frame while applying a negative control voltage to another driving transistor, and the control voltages having polarities opposite to the previous frame are applied to the respective driving transistors in the next frame, displaying the target images and preventing the deterioration of the driving transistors.

An organic light emitting display according to an embodiment of the present invention will be specifically explained with reference to FIGS. 11 and 12.

Figure 11:
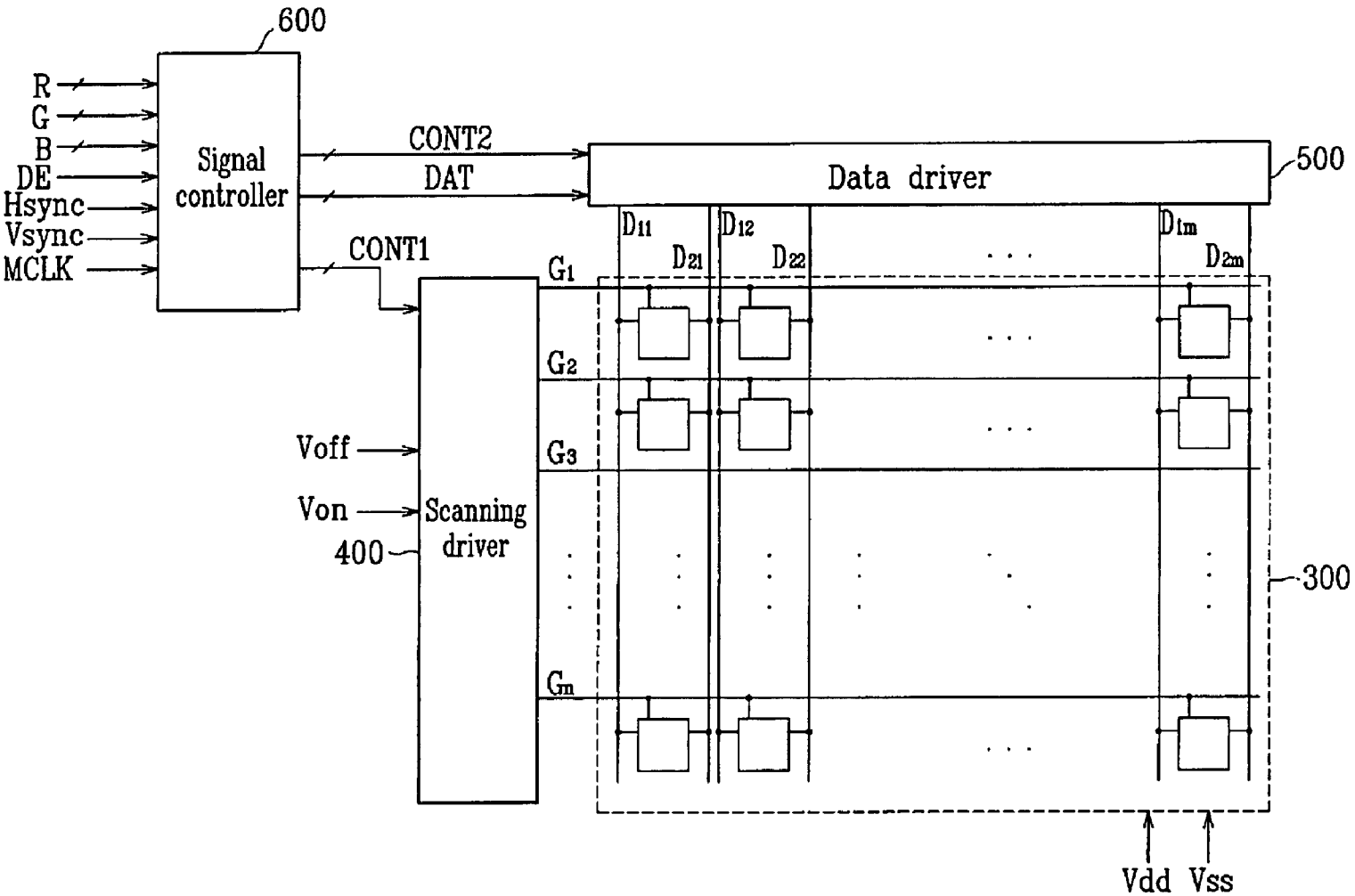
FIG. 11 is a block diagram of an organic light emitting display according to an embodiment of the present invention.
Figure 12:
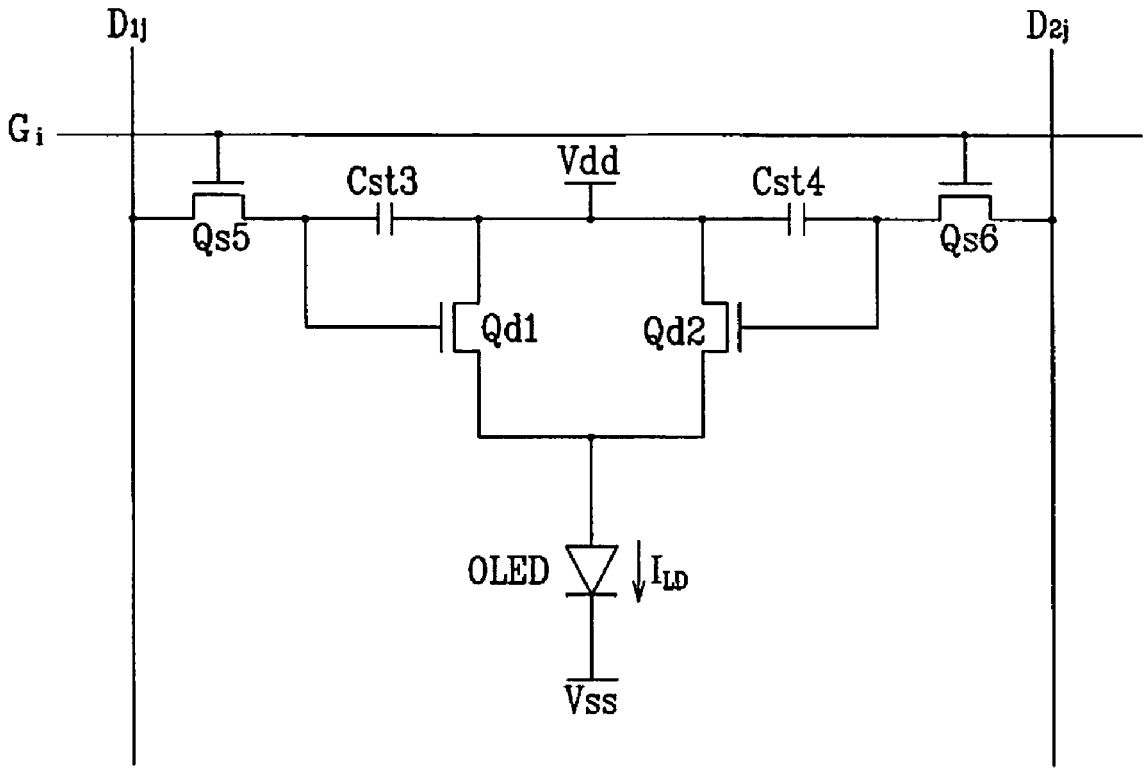
FIG. 12 is an equivalent circuit diagram of a pixel of an organic light emitting display according to an embodiment of the present invention.

FIG. 11 is a block diagram of an organic light emitting display, and FIG. 12 is an equivalent circuit diagram of a pixel of an organic light emitting display.

As shown in FIG. 11, the organic light emitting display includes a display panel 300, scanning and data drivers 400 and 500 connected to the display panel 300, and a signal controller 600 for controlling the scanning and data drivers 400 and 500.

From an equivalent circuit perspective, the display panel 300 includes a plurality of signal lines G1-Gn and D11-D2*m*, a plurality of driving voltage lines (not shown), and a plurality of pixels connected to those lines and arranged substantially in the form of a matrix.

The signal lines include a plurality of scanning signal lines G1-Gn for transmitting scanning signals, and a plurality of data lines D11-D2*m*. The scanning signal lines G1-Gn extend substantially in the pixel row direction and substantially parallel to each other. The data lines D11-D2*m* extend substantially in the pixel column direction and substantially parallel to each other.

The driving voltage lines transmit a driving voltage Vdd, and extend substantially in the pixel row or column direction.

As shown in FIG. 12, the respective pixels include an OLED, first and second driving transistors Qd1 and Qd2, third and fourth capacitors Cst3 and Cst4, and fifth and sixth switching transistors Qs5 and Qs6.

The first and the second driving transistors Qd1 and Qd2 have triode structures with input terminals connected to each other to receive a driving voltage Vdd, and output terminals connected to each other. The output terminals of the transistors Qd1 and Qd2 are connected to the OLED. The control terminal of the first driving transistor Qd1 is connected to the third capacitor Cst3 and the fifth switching transistor Qs5, and the control terminal of the second driving transistor Qd2 is connected to the fourth capacitor Cst4 and the sixth switching transistors Qs6.

The anode and the cathode of the OLED are connected to the output terminals of the first and the second driving transistors Qd1 and Qd2, and the common voltage Vss, respectively.

The fifth and the sixth switching transistors Qs5 and Qs6 each also have a triode structure. The control terminals of the fifth and the sixth switching transistors Qs5 and Qs6 are connected to the scanning signal lines G1-Gn, and the input terminals thereof to the first data lines D11-D1*m* and the second data lines D21-D2*m*. The output terminal of the fifth switching transistor Qs5 is connected to the control terminal of the first driving transistor Qd1 and the third capacitor Cst3, and the output terminal of the sixth switching transistor Qs6 to the control terminal of the second driving transistor Qd2 and the fourth capacitor Cst4.

As with the driving transistors Qd1 and Qd2, the switching transistors Qs5 and Qs6 are formed with n channel metallic oxide film semiconductor nMOS transistors based on amorphous silicon or polycrystalline silicon. The fifth switching transistor Qs5 transmits the data voltages from the data lines D11-D1*m* to the first driving transistor Qd1 and the third capacitor Cst3 in accordance with the scanning signals, and the sixth switching transistor Qs6 transmits the data voltages from the data lines D21-D2*m* to the second driving transistor Qd2 and the fourth capacitor Cst4 in accordance with the scanning signals.

The third capacitor Cst3 is connected between the control terminal of the first driving transistor Qd1 and the driving voltage Vdd, and charges and holds the data voltage from the fifth switching transistor Qs5.

The fourth capacitor Cst4 is connected between the control terminal of the second driving transistor Qd2 and the driving voltage Vdd, and charges and holds the data voltage from the sixth switching transistors Qs6.

The first and the second driving transistors Qd1 and Qd2 output first and second electric currents depending upon the voltage Vgs between the control terminal and the output terminal. The OLED emits light of varying intensity depending upon the voltage of the first or the second electric current, displaying the target images.

The structure of the OLED and the first and the second driving transistors Qd1 and Qd2 is the same as that of the organic light emitting unit described with respect to FIG. 1, and hence, detailed explanation thereof will be omitted.

As shown in FIG. 12, the scanning driver 400 is connected to the scanning signal lines G1-Gn of the display panel 300 to apply scanning signals based on a combination of a high voltage Von capable of turning on the switching transistors Qs5 and Qs6 and a low voltage Voff capable of turning off the switching transistors Qs5 and Qs6 to the scanning signal lines G1-Gn. The scanning driver 400 may be formed of a plurality of integrated circuits.

The data driver 500 is connected to the data lines D11-D2*m* of the display panel 300 to alternately apply the positive and the negative data voltages to the first data lines D11-D1*m* and the second data lines D21-D2*m*. The data driver 500 may be formed of a plurality of integrated circuits.

The signal controller 600 controls the operation of the scanning and the data drivers 400 and 500.

The display operation of the organic light emitting display will be explained.

In the odd-numbered frames, the data driver 500 sequentially receives and shifts the image data DAT with respect to a row of pixels in accordance with the data control signals CONT2 from the signal controller 600, and applies the positive data voltages corresponding to the respective image data DAT to the relevant data lines D11-D1*m*. Furthermore, the data driver 500 applies the negative data voltages to the relevant data lines D21-D2*m*. The negative data voltage has a predetermined voltage, and is preferably proportional to the voltage of the positive data voltage in the previous frame.

The scanning driver 400 applies the high voltage Von to the scanning signal lines G1-Gn in accordance with the scanning control signals CONT1 from the signal controller 600, and turns on the switching transistors Qs5 and Qs6 connected to the scanning signal lines G1-Gn. The positive data voltage applied to the first data lines D11-D1*m* is applied to the relevant capacitor Cst3 via the turned on switching transistor Qs5, and the negative data voltage applied to the second data lines D21-D2*m* is applied to the relevant capacitor Cst4 via the turned on switching transistor Qs6. The first driving transistor Qd1 turns on in accordance with the positive voltage charged at the third capacitor Cst3, and outputs electric current. Upon receipt of the electric current $I_{OLED}$, the OLED emits light. The second driving transistor Qd2 is reverse-biased due to the negative voltage charged at the fourth capacitor Cst4. This operation is repeated for the respective rows of pixels.

In the even-numbered frames, the data driver 500 sequentially receives and shifts the image data DAT with respect to a row of pixels in accordance with the data control signals CONT2 from the signal controller 600, and applies the positive data voltages corresponding to the respective image data DAT to the relevant data lines D21-D2*m*. Furthermore, the data driver 500 applies the negative data voltages to the relevant data lines D11-D1*m*. The negative data voltage has a predetermined voltage, and is preferably proportional to the voltage of the positive data voltage in the previous frame.

The scanning driver 400 applies the high voltage Von to the scanning signal lines G1-Gn in accordance with the scanning control signals CONT1 from the signal controller 600, and turns on the switching transistors Qs5 and Qs6 connected to the scanning signal lines G1-Gn. The positive data voltage applied to the second data lines D21-D2*m* is applied to the relevant capacitor Cst4 via the turned on switching transistor Qs6, and the negative data voltage applied to the first data lines D11-D1*m* is applied to the relevant capacitor Cst3 via the turned on switching transistor Qs5. The second driving transistor Qd2 turns on in accordance with the positive voltage charged at the fourth capacitor Cst4, and outputs electric current. Upon receipt of the electric current $I_{OLED}$, the OLED emits light. The first driving transistor Qd1 is reverse-biased due to the negative voltage charged at the third capacitor Cst3. This operation is repeated for the respective rows of pixels.

As shown in FIG. 10, the polarities of the control voltages Vg1 and Vg2 applied to the control terminals of the driving transistors Qd1 and Qd2 at one pixel are opposite to each other in one frame, and alternated per frame. Accordingly, the target images are displayed with the positive control voltages, and the deterioration of the driving transistors is substantially prevented with the negative control voltages. Furthermore, the number of switching transistors and scanning signal lines is relatively small, and hence, the pixel aperture ratio is enhanced.

As described above, with the inventive structure, the control electrodes of the driving transistors are located below and over the semiconductor. Two driving transistors are formed at each pixel, and the occupation area thereof within a pixel is reduced, enhancing the aperture ratio.

Furthermore, the control terminals of the two driving transistors are connected to each other to generate output electric current with a low data voltage, substantially removing the stress due to the high voltage and substantially preventing the deterioration of the driving transistors.

In addition, a positive control voltage is applied to any one of the driving transistors in one frame while applying a negative control voltage to another driving transistor, and control voltages having polarities opposite to the previous are applied to the respective driving transistors, substantially preventing the deterioration of the driving transistors.

While the present invention has been described in detail with reference to preferred embodiments, those skilled in the art will appreciate that various modifications and substitutions can be made thereto without departing from the spirit and scope of the present invention.

What is claimed is:

1. A display device comprising:

a light emitting diode; and first and second driving transistors connected between a driving voltage and the light emitting diode to supply a driving electric current to the light emitting diode;

wherein a control voltage or control voltages differentiated in polarity from each other are applied to control terminals of the first and the second driving transistors, the first driving transistor and the second driving transistor commonly comprise a semiconductor layer, and the first driving transistor further comprises a control electrode located below the semiconductor layer while the second driving transistor further comprises a control electrode located over the semiconductor layer.

2. The display device of claim 1 further comprising a capacitor connected to the control terminals of the first and the second driving transistors, and a switching transistor for transmitting a data voltage to the capacitor in accordance with a scanning signal, wherein the control terminals of the first and the second driving transistors are connected to each other.

3. The display device of claim 1 wherein first and second control voltages are applied to the control terminals of the first and the second driving transistors, respectively, and the polarities of the first and the second control voltages are alternated per image frame.

4. The display device of claim 1 further comprising a first capacitor connected to the control terminal of the first driving transistor to charge and apply a first control voltage to the control terminal of the first driving transistor, and a second capacitor connected to the control terminal of the second driving transistor to charge and apply a second control voltage to the control terminal of the second driving transistor.

5. The display device of claim 4 further comprising a first switching transistor for transmitting a first data voltage to the first capacitor in accordance with a scanning signal, and a second switching transistor for transmitting a second data voltage to the second capacitor in accordance with the scanning signal.

6. The display device of claim 5 wherein the first and the second data voltages are differentiated in polarity from each other.

7. The display device of claim 6 wherein the polarities of the first and the second data voltages are alternated per image frame.

8. The display device of claim 4 further comprising a first switching transistor for transmitting a first data voltage to the first capacitor in accordance with a first scanning signal, a second switching transistor for transmitting a second data voltage to the second capacitor in accordance with the first scanning signal, a third switching transistor for transmitting the second data voltage to the first capacitor in accordance with a second scanning signal, and a fourth switching transistor for transmitting the first data voltage to the second capacitor in accordance with the second scanning signal.

9. The display device of claim 8 wherein the first and the second data voltages are differentiated in polarity from each other.

10. The display device of claim 9 wherein the first and the second scanning signals are activated in different image frames.

11. The display device of claim 1 wherein the first and the second driving transistors are amorphous silicon thin film transistors.

12. The display device of claim 1 wherein the first and the second driving transistors are nMOS thin film transistors.

13. The display device of claim 1 wherein the light emitting diode comprises an organic light emitting layer.

14. A display device comprising:

a substrate;

a first control electrode formed on the substrate;

an insulating layer formed on the first control electrode;

a semiconductor formed on the insulating layer;

input and output electrodes formed on the semiconductor;

a passivation layer formed on the input and the output electrodes; and a second control electrode formed on the passivation layer;

wherein first and second control voltages differentiated in polarity from each other are applied to the first and the second control electrodes, respectively.

15. The display device of claim 14 wherein the polarities of the first and the second control voltages are alternated per image frame.

16. The display device of claim 14 further comprising an etch stopper formed between the semiconductor and the passivation layer.

17. A method of driving a display device comprising a light emitting diode, first and second driving transistors connected to the light emitting diode and first and second capacitors connected to the first and the second driving transistors, respectively, the method comprising:

applying a positive control voltage to a control terminal of the first driving transistor in a first image frame;

applying a negative control voltage to a control terminal of the second driving transistor in the first image frame;

applying a negative control voltage to the control terminal of the first driving transistor in a second image frame; and applying a positive control voltage to the control terminal of the second driving transistor in the second image frame.

18. The method of claim 17 further comprising the steps of:

applying a positive data voltage to the first capacitor in the first image frame;

applying a negative data voltage to the second capacitor in the first image frame;

applying a negative data voltage to the first capacitor in the second image frame; and applying a positive data voltage to the second capacitor in the second image frame.

* * * * *